US007931211B2

(12) United States Patent
Yamamoto et al.

(10) Patent No.: US 7,931,211 B2
(45) Date of Patent: Apr. 26, 2011

(54) INJECTOR

(75) Inventors: Norio Yamamoto, Nagoya (JP); Masatoshi Kuroyanagi, Kariya (JP); Kouichi Mochizuki, Anjo (JP)

(73) Assignee: Denso Corporation, Kariya (JP)

( * ) Notice: Subject to any disclaimer, the term of this patent is extended or adjusted under 35 U.S.C. 154(b) by 367 days.

(21) Appl. No.: 12/031,801

(22) Filed: Feb. 15, 2008

(65) Prior Publication Data

US 2008/0217428 A1 Sep. 11, 2008

(30) Foreign Application Priority Data

Mar. 5, 2007 (JP) ..... 2007-054121

(51) Int. Cl.
*F02M 47/02* (2006.01)

(52) U.S. Cl. ..... 239/88; 239/102.2; 239/584; 239/533.9

(58) Field of Classification Search ..... 239/88–92, 239/96, 102.1, 102.2, 533.8, 584, 585.1, 239/585.4, 533.2, 533.9, 533.12; 251/129.06
See application file for complete search history.

(56) References Cited

U.S. PATENT DOCUMENTS

| | | | | |
|---|---|---|---|---|
| 5,651,503 | A | 7/1997 | Ricco | |
| 5,697,554 | A | 12/1997 | Auwaerter et al. | |
| 5,875,632 | A | 3/1999 | Kappel et al. | |
| 6,216,964 | B1 * | 4/2001 | Lambert | 239/533.12 |
| 7,100,895 | B2 | 9/2006 | Schurz et al. | |
| 7,455,244 | B2 | 11/2008 | Boecking | |
| 2006/0219805 | A1 * | 10/2006 | Boecking | 239/96 |
| 2007/0152084 | A1 * | 7/2007 | Boecking | 239/533.2 |

FOREIGN PATENT DOCUMENTS

| | | |
|---|---|---|
| DE | 103 53 045 | 6/2005 |
| EP | 1 571 328 | 9/2005 |
| JP | U-1-114975 | 8/1989 |
| JP | A-5-215038 | 8/1993 |
| WO | WO 2005/026531 | 3/2005 |
| WO | 2005/075811 | 8/2005 |

OTHER PUBLICATIONS

German Office Action dated Oct. 19, 2009, issued in corresponding German Application No. 10 2008 000 511.8-13, with English translation.

* cited by examiner

*Primary Examiner* — Jason J Boeckmann
(74) *Attorney, Agent, or Firm* — Nixon & Vanderhye PC

(57) ABSTRACT

A pressurizing piston has a head section, which contacts an axial end face of a piezoelectric actuator to receive displacement of the actuator, and a piston wall section, which is formed in a cylindrical shape and can move in an axial direction in response to the movement of the head section. The head section and the piston wall section are combined such that relative displacement therebetween is possible in a radial direction. An outer sleeve slidably holding an outer periphery of the piston wall section restricts radial movement of the head section. When an expansion-contraction direction of the actuator inclines with respect to the axial direction, inclination of the piston wall section is inhibited by a radial deviation caused between the head section and the piston wall section. Thus, pinching of the piston wall section to the outer sleeve is inhibited.

4 Claims, 3 Drawing Sheets

INJECTOR

CROSS REFERENCE TO RELATED APPLICATION

This application is based on and incorporates herein by reference Japanese Patent Application No. 2007-54121 filed on Mar. 5, 2007.

BACKGROUND OF THE INVENTION

1. Field of the Invention

The present invention relates to an injector that controls opening/closing action of a needle by increasing/decreasing control pressure of a pressure control chamber through movement of a pressurizing piston driven by a piezoelectric actuator.

2. Description of Related Art

An injector using an electromagnetic valve as an actuator is commonly used. In order to realize a large flow rate and high response, an injector using a piezoelectric actuator with a large generative force and high response is proposed. For example, an injector described in patent document 1 (International Publication No. 2005/075811) has a piezoelectric actuator 100 that makes a displacement when voltage is applied thereto, a pressurizing piston 110 driven by the piezoelectric actuator 100, an outer sleeve 120 for slidably holding an outer periphery of the pressurizing piston 110, a pressure control chamber 130, internal pressure (oil pressure) of which increases/decreases according to the movement of the pressurizing piston 110, a needle 160 that is held inside a valve body 140 and that has a function to open/close an injection hole 150 and the like as shown in FIG. 6.

The pressure control chamber 130 is fluid-tightly defined by the pressurizing piston 110, the outer sleeve 120, the needle 160 and the valve body 140. If the voltage is applied to the piezoelectric actuator 100 and the pressurizing piston 110 is depressed downward in the drawing, the volume of the pressure control chamber 130 decreases and the internal pressure rises.

The internal pressure of the pressure control chamber 130 acts on a pressure receiving face 161 formed in the needle 160 to function as a valve opening force for biasing the needle 160 in a valve opening direction (upward direction in the drawing). If the valve opening force exceeds a valve-closing force (reaction force of a spring 170 and the like) biasing the needle 160 in a valve closing direction, the needle 160 lifts and opens the injection hole 150. Thus, the high pressure fuel supplied to an inside of the valve body 140 is injected into a combustion chamber 180 of the engine from the injection hole 150.

There is a possibility that an expansion-contraction direction of the piezoelectric actuator 100 inclines with respect to the axial direction of the injector when the fixation accuracy of the piezoelectric actuator 100 is low or because there is a variation among the products. In this case, since the above-mentioned injector is structured such that the piezoelectric actuator 100 and the pressurizing piston 110 contact each other in a plane, if the inclination arises in the expansion-contraction direction of the piezoelectric actuator 100, the driving force of the piezoelectric actuator 100 is transmitted to the pressurizing piston 110 in the inclined direction. Accordingly, the moving direction of the pressurizing piston 110 is inclined with respect to the axial direction, causing a distortion in sliding sections of the pressurizing piston 110 and the needle 160. As a result, there is a possibility that a malfunction of the needle 160 occurs.

SUMMARY OF THE INVENTION

It is an object of the present invention to provide an injector capable of inhibiting a malfunction of a needle even when an inclination arises in an expansion-contraction direction of a piezoelectric actuator.

According to an aspect of the present invention, an injector has a piezoelectric actuator that causes displacement in an axial direction thereof when voltage is applied thereto, a pressurizing piston that is driven by the piezoelectric actuator to move in the axial direction, a guide wall section that slidably holds an outer periphery of the pressurizing piston, a valve body that has an injection hole in an axial tip end portion thereof for injecting high pressure fuel, a needle that is held by the valve body and that operates to open/close the injection hole, and a pressure control chamber for accumulating control pressure concerning the opening/closing operation of the needle. The injector controls the opening/closing operation of the needle by increasing/decreasing the control pressure of the pressure control chamber through the movement of the pressurizing piston. The needle has a middle shaft section held by the valve body, a needle head section that is provided on a side of the middle shaft section opposite from the injection hole and that has an outer diameter larger than that of the middle shaft section, and a pressure receiving surface between the middle shaft section and the needle head section for receiving the control pressure of the pressure control chamber in a valve opening direction. The pressurizing piston has a head section that contacts an axial end face of the piezoelectric actuator to receive the displacement of the piezoelectric actuator and a cylindrical piston wall section that moves in the axial direction in response to the movement of the head section. The piston wall section and the head section are combined such that relative movement therebetween in a radial direction is possible. An outer periphery of the needle head section is held to an inner periphery of the piston wall section such that the needle head section can move in the axial direction in a sliding manner. An outer periphery of the piston wall section is held by the guide wall section such that the piston wall section can move in the axial direction in a sliding manner.

If an expansion-contraction direction (direction in which displacement occurs) of the piezoelectric actuator inclines with respect to the axial direction, the driving force of the piezoelectric actuator is applied to the head section of the pressurizing piston in the inclined direction. In this case, an axial component force and a radial component force act on the head section. If the radial component force becomes larger than a static friction force generated on contact faces of the head section and the piston wall section, the head section moves in the radial direction against the static friction force. That is, a deviation in the radial direction arises between the head section and the piston wall section. Thus, inclination of the piston wall section in the expansion-contraction direction of the piezoelectric actuator can be inhibited. Accordingly, pinching of the piston wall section to the guide wall section can be inhibited. As a result, the clearance between the sliding sections of the piston wall section and the needle can be secured, so the opening/closing operation of the needle can be performed certainly.

According to another aspect of the invention, the piston wall section and the head section are provided such that the piston wall section and the head section can cause the relative displacement in the radial direction in a dimension more than ten times as large as a sliding clearance between the guide wall section and the piston wall section.

When the pressurizing piston is pressed by the piezoelectric actuator with a heavy load, there is a possibility that a relative positional deviation in the radial direction is caused between the head section and the piston wall section, e.g., by a variation in the dimension of the contact faces of the head section and the piston wall section.

In contrast, in the present invention, the dimension of the possible relative movement of the piston wall section and the head section in the radial direction is set more than ten times as large as the sliding clearance between the guide wall section and the piston wall section. That is, the dimension is set larger than the relative deviation considering the product variation. Accordingly, the outer peripheral face of the head section does not press the inner peripheral face of the guide wall section in the radial direction. Thus, the pinching of the piston wall section including the head section to the inner peripheral face of the guide wall section is prevented, so the axial movement is stabilized.

According to another aspect of the invention, the injector has a valve housing surrounding the periphery of the head section. The valve housing restricts the radial movement of the head section. Accordingly, large movement of the head section in the radial direction more than necessity is inhibited. As a result, a problem caused by the radial movement of the head section such as the air-tightness leakage of the pressure control chamber or the defective operation of the needle can be prevented.

According to another aspect of the invention, the piston wall section has a depressed groove with a depressed inner peripheral face in an axial end face thereof on the head section side and an outer peripheral wall standing on an outer periphery of the depressed groove. The head section is loosely fitted to the depressed groove such that the outer peripheral wall restricts the radial movement of the head section. Accordingly, large movement of the head section in the radial direction more than necessity is inhibited. As a result, a problem caused by the radial movement of the head section such as the air-tightness leakage of the pressure control chamber or the defective operation of the needle can be prevented.

According to another aspect of the invention, the guide wall section restricts the radial movement of the head section. Accordingly, large movement of the head section in the radial direction more than necessity is inhibited. As a result, a problem caused by the radial movement of the head section such as the air-tightness leakage of the pressure control chamber or the defective operation of the needle can be prevented.

According to yet another aspect of the invention, the head section has a convex contact surface, at which the head section contacts an axial end face of the piezoelectric actuator. With this structure, the head section contacts the axial end face of the piezoelectric actuator in one point. Therefore, even when the inclination arises in the expansion-contraction direction of the piezoelectric actuator, the actuator can drive the head section in the axial direction. Accordingly, pinching of the piston wall section to the guide wall section can be inhibited. As a result, the clearance between the sliding sections of the piston wall section and the needle can be secured, so the opening/closing action of the needle can be performed certainly.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
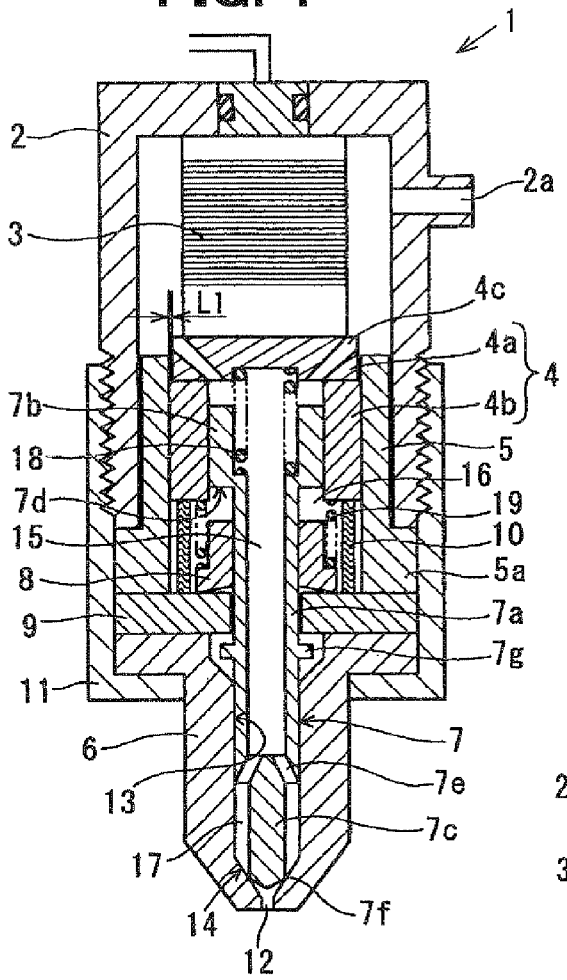
FIG. 1 is a sectional view showing an injector according to a first embodiment of the present invention.

Referring to FIG. 1, an injector according to a first embodiment of the present invention is illustrated. The injector 1 of the present embodiment is a device that is attached to each cylinder of a diesel engine and that injects high pressure fuel supplied from a common rail (not shown) directly into a combustion chamber in the cylinder, for example. As shown in FIG. 1, the injector 1 has a valve housing 2, a piezoelectric actuator 3, a pressurizing piston 4, an outer sleeve 5, a valve body 6, a needle 7, an inner sleeve 8 and the like.

The valve housing 2 is formed with a fuel inlet 2*a* connected to the common rail through a fuel pipe (not shown). An interior space of the injector 1 is filled with high pressure fuel flowing in from the fuel inlet 2*a*.

The piezoelectric actuator 3 is a common actuator having a capacitor structure of alternately laminated piezoelectric ceramic layers such as PZT (lead zirconate titanate) and electrode layers, for example. If voltage is applied, the piezoelectric actuator 3 elongates in the lamination direction. The piezoelectric actuator 3 is arranged inside the valve housing 2. An end (upper side in FIG. 1) of the piezoelectric actuator 3 in the lamination direction is fixed to the valve housing 2.

The pressurizing piston 4 consists of a head section 4*a* and a piston wall section 4*b*. The head section 4*a* contacts an axial end face of the piezoelectric actuator 3 to receive displacement of the piezoelectric actuator 3. The piston wall section 4*b* is formed in a cylindrical shape and can move in the axial direction (vertical direction in FIG. 1) in response to the movement of the head section 4*a*. The head section 4*a* and the piston wall section 4*b* are combined with each other such that relative displacement therebetween is possible in the radial direction.

The head section 4*a* has an outer diameter slightly smaller than that of the piston wall section 4*b*. The outer sleeve 5 surrounding the periphery of the head section 4*a* restricts radial movement of the head section 4*a*. A predetermined clearance L1 (refer to FIG. 1) is secured between an outer peripheral face of the head section 4*a* and an inner peripheral face of the outer sleeve 5. The head section 4*a* can move in the radial direction by the clearance L. The head section 4*a* is formed with a communication hole 4*c*, through which the high pressure fuel can pass.

The piston wall section 4*b* is provided such that an axial end face thereof contacts an end face of the head section 4*a* opposite from the actuator 3 and is pressed against the head section 4*a* by a reaction force of an elastic body 10 arranged between the piston wall section 4*b* and a spacing member 9. Thus, the head section 4*a* receives the reaction force of the elastic body 10 through the piston wall section 4*b* and is pressed against the axial end face of the piezoelectric actuator 3.

The spacing member 9 has a function to restrict a valve opening lift position of the needle 7 and is arranged to contact an axial end face (end face opposite from the injection hole side) of the valve body 6. A circular hole, through which the needle 7 is freely inserted, is formed in the radial center of the spacing member 9.

The outer sleeve 5 forms a cylindrical guide hole and slidably holds the outer periphery of the piston wall section 4*b* at an inner periphery of the guide hole. That is, the pressurizing piston 4 is capable of moving in the axial direction while the outer periphery of the piston wall section 4*b* is guided by the guide hole. The outer sleeve 5 has a flange section 5*a* projecting radially outward. The flange section 5*a* is held between an opening end face of the valve housing 2 and the spacing member 9.

The clearance L1 (the gap set between the outer peripheral face of the head section 4*a* and the inner peripheral face of the outer sleeve 5) is set at a size (for example, 30 to 100 micrometers) tens times as large as the size of a sliding gap (for example, 1 to 3 micrometers) secured between the outer sleeve 5 and the piston wall section 4*b*.

The valve body 6 is fixed to the valve housing 2 by a retaining nut 11 together with the outer sleeve 5 and the spacing member 9. An injection hole 12 for injecting the fuel and a cylinder hole 13 for holding the needle 7 are formed in the valve body 6.

The injection hole 12 is formed in a tip end portion (lower end portion in the drawing) of the valve body 6 projecting into the combustion chamber of the diesel engine. The cylinder hole 13 is bored from an axial end face of the valve body 6 toward the tip end portion. A seat face 14 in a conical shape is formed at a tip end portion of the cylinder hole 13.

The needle 7 has a middle shaft section 7*a* slidably held at the cylinder hole 13, a needle head section 7*b* provided on an end side (opposite from the injection hole side) of the middle shaft section 7*a*, and a small diameter shaft section 7*c* provided on the other end side of the middle shaft section 7*a*. The portion from the needle head section 7*b* to the middle shaft section 7*a* is formed to be hollow, and the inside of the hollow is used as a fuel passage 15.

The needle head section 7*b* has a larger external diameter than the middle shaft section 7*a* and is held slidably at an inner periphery of the piston wall section 4*b*. A pressure receiving face 7*d* is formed between the needle head section 7*b* and the middle shaft section 7*a* for receiving control pressure of a pressure control chamber 16 (mentioned later) in the valve opening direction (upward direction in the drawing).

The small diameter shaft section 7*c* has an external diameter smaller than the middle shaft section 7*a*. A fuel sump 17 is formed between the outer periphery of the small diameter shaft section 7*c* and the inner periphery of the cylinder hole 13. A communication hole 7*e* connecting the above-mentioned fuel passage 15 and the fuel sump 17 is formed in the stepped portion between the middle shaft section 7*a* and the small diameter shaft section 7*c*. A seat section 7*f* is provided in the tip end portion of the small diameter shaft section 7*c* and is seated on the seat face 14 of the valve body 6 at the time of the valve-closing of the needle 7.

A step is formed on the inner periphery of the needle head section 7*b* of the needle 7. The needle 7 is biased in the valve closing direction (downward direction in the drawing) by a reaction force of a spring 18 located between the step and the head section 4*a* of the pressurizing piston 4.

A flange section 7*g* projecting radially outward from the middle shaft section 7*a* is provided to the needle 7. When the needle 7 lifts in the valve opening direction, the flange section 7*g* contacts the spacing member 9 and thus the valve opening lift position of the needle 7 is restricted.

The pressure control chamber 16 is a hermetic space for storing the control pressure for controlling opening/closing action of the needle 7 and is defined by the spacing member 9, the outer sleeve 5, the piston wall section 4*b*, the needle 7, and the inner sleeve 8. The inside of the pressure control chamber 16 is filled with the high pressure fuel, and internal pressure thereof increases/decreases according to the axial movement of the piston wall section 4*b*. The internal pressure acts on the pressure receiving face 7*d* of the needle 7 and functions as a valve opening force for biasing the needle 7 in the valve opening direction (upward in the drawing).

The inner sleeve 8 is slidably fitted to the outer periphery of the middle shaft section 7*a* of the needle 7 protruding farther than the spacing member 9 in a direction opposite to the injection hole side (upward direction in the drawing). The inner sleeve 8 is biased by a spring 19 located between the inner sleeve 8 and the piston wall section 4*b*. Thus, an edge section at an axial tip end of the inner sleeve 8 is pressed against the face of the spacing member 9.

Next, an operation of the injector 1 according to the present embodiment will be explained. When the voltage is not applied to the piezoelectric actuator 3, that is, when there is no displacement is caused in the piezoelectric actuator 3, the valve-closing force exceeds the control pressure (valve opening force) applied to the pressure receiving face 7*d* of the needle 7. Accordingly, the seat section 7*f* of the needle 7 is seated on the seat face 14 of the valve body 6 to provide the valve closing state (refer to FIG. 1).

If the voltage is applied to the piezoelectric actuator 3, the displacement occurs in the piezoelectric actuator 3 and the pressurizing piston 4 is pushed downward (in the drawing) due to the displacement. Accordingly, the volume of the pressure control chamber 16 decreases and the control pressure rises.

Thus, if the valve opening force acting on the pressure receiving face 7*d* of the needle 7 exceeds the valve-closing force, the needle 7 lifts to provide the communication between the fuel sump 17 and the injection hole 12. Accordingly, the high pressure fuel supplied through the fuel sump 17 is injected from the injection hole 12 to the combustion chamber of the diesel engine.

Then, if the energization to the piezoelectric actuator 3 is stopped and the displacement is ceased (i.e., contraction occurs), the pressurizing piston 4 is pushed back by the reaction force of the elastic body 10. Thus, the control pressure of the pressure control chamber 16 is decreased. Thus, if the valve opening force acting on the pressure receiving face 7*d* of the needle 7 becomes smaller than the valve-closing force, the needle 7 is depressed by the reaction force of the spring 19, so the seat section 7*f* of the needle 7 is seated on the seat face 14 of the valve body 6 and the communication between the fuel sump 17 and the injection hole 12 is broken. Thus, the injection ends.

In the injector 1 of the present embodiment, the pressurizing piston 4 is divided into the head section 4*a* and the piston wall section 4*b*, and the two sections 4*a*, 4*b* are put together such that the sections 4*a*, 4*b* can cause relative displacement in the radial direction. Thus, even when the expansion-contraction direction (direction in which displacement occurs) of the piezoelectric actuator 3 inclines with respect to the axial direction, the normal opening/closing action of the needle 7 can be maintained. That is, if the expansion-contraction direction of the piezoelectric actuator 3 inclines with respect to the axial direction, the driving force of the piezoelectric actuator 3 is applied to the head section 4*a* of the pressurizing piston 4 in the inclined direction. Accordingly, the head section 4*a* receives an axial component force and a radial component force. At this time, if the radial component force becomes larger than a static friction force produced on contact faces of the head section 4*a* and the piston wall section 4*b*, the head section 4*a* moves in the radial direction against the static friction force. That is, a deviation in the radial direction arises between the head section 4*a* and the piston wall section 4*b*. Thus, inclination of the piston wall section 4*b* in the expansion-contraction direction of the piezoelectric actuator 3 can be inhibited. Accordingly, pinching of the piston wall section 4*b* to the outer sleeve 5 can be inhibited. As a result, the clearance in the sliding section between the piston wall section 4*b* and the needle 7 can be secured, and the opening/closing action of the needle 7 can be performed certainly.

When the pressurizing piston 4 is pressed by the piezoelectric actuator 3 with a heavy load, there is a possibility that a relative positional deviation in the radial direction is caused between the head section 4*a* and the piston wall section 4*b*, e.g., by a variation in the dimension of the contact faces of the head section 4*a* and the piston wall section 4*b*. In contrast, in the injector 1 of the present embodiment, the dimension L1 of the possible relative movement of the piston wall section 4*b* and the head section 4*a* in the radial direction is set more than ten times as large as the sliding clearance between the outer sleeve 5 and the piston wall section 4*b*. That is, the dimension is set larger than the relative deviation considering the product variation. Accordingly, the outer peripheral face of the head section 4*a* does not press the inner peripheral face of the outer sleeve 5 in the radial direction. Thus, the pinching of the piston wall section 4*b* including the head section 4*a* to the inner peripheral face of the outer sleeve 5 is prevented, so the axial movement is stabilized.

The radial movement of the head section 4*a* of the pressurizing piston 4 is restricted by the outer sleeve 5. Therefore, large movement of the head section 4*a* in the radial direction more than necessity is inhibited. As a result, a problem caused by the radial movement of the head section 4*a* such as airtightness leakage of the pressure control chamber 16 or the defective operation of the needle 7 can be prevented.

Since the pressurizing piston 4 is divided into the head section 4*a* and the cylindrical piston wall section 4*b*, the inner peripheral face of the piston wall section 4*b* can be processed with sufficient accuracy over total axial length, so the sliding clearance between the needle head section 7*b* and the piston wall section 4*b* can be secured with high accuracy.

Figure 2:
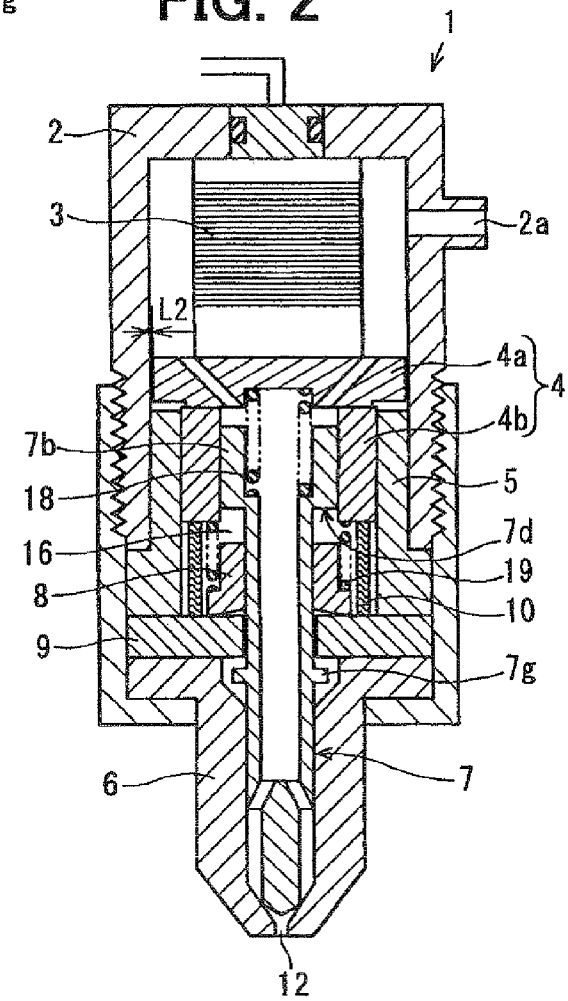
FIG. 2 is a sectional view showing an injector according to a second embodiment of the present invention.

Next, an injector 1 according to a second embodiment of the present invention will be described with reference to FIG. 2. FIG. 2 is a sectional view showing the injector 1 according to the present embodiment. As shown in FIG. 2, the pressurizing piston 4 of the present embodiment is formed such that the outer diameter of the head section 4*a* is larger than the outer diameter of the piston wall section 4*b*. A predetermined clearance L2 (with dimension enabling relative movement between the piston wall section 4*b* and the head section 4*a* in the radial direction) is provided between the outer peripheral face of the head section 4*a* and the inner peripheral face of the valve housing 2. The clearance L2 is set at a size (for example, 30 to 100 micrometers) tens times as large as the size of a sliding gap (for example, 1 to 3 micrometers) secured between the outer sleeve 5 and the piston wall section 4*b* like the first embodiment. Thus, the radial movement of the head section 4*a* is restricted by the valve housing 2, so the same effect as the first embodiment can be exerted.

Figure 3:
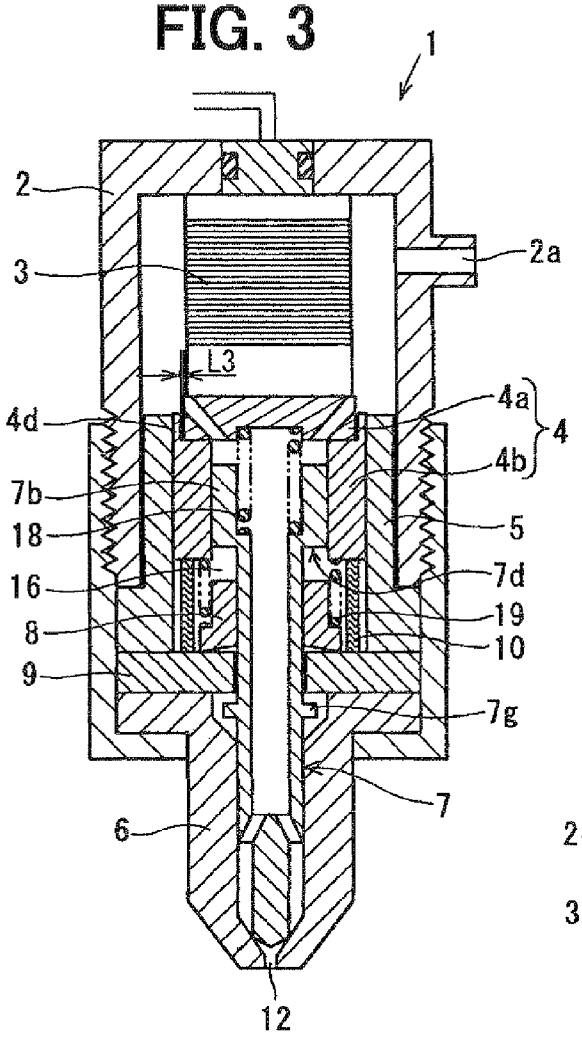
FIG. 3 is a sectional view showing an injector according to a third embodiment of the present invention.

Next, an injector 1 according to a third embodiment of the present invention will be described with reference to FIG. 3. FIG. 3 is a sectional view of the injector 1 according to the present embodiment. The present embodiment is an example for restricting radial movement of the head section 4*a* with the piston wall section 4*b*. As shown in FIG. 3, a depressed groove having a depressed inner peripheral face is formed in an axial end face of the piston wall section 4*b* on the head section 4*a* side. The piston wall section 4*b* has an outer peripheral wall 4*d* standing on the outer periphery of the depressed groove.

The head section 4*a* is loosely fitted to the depressed groove formed in the piston wall section 4*b*. A predetermined clearance L3 (with dimension enabling relative movement between the piston wall section 4*b* and the head section 4*a* in the radial direction) is provided between the outer peripheral face of the head section 4*a* and the outer peripheral wall 4*d*. The clearance L3 is set at a size (for example, 30 to 100 micrometers) tens times as large as the size of a sliding gap (for example, 1 to 3 micrometers) secured between the outer sleeve 5 and the piston wall section 4*b* like the first embodiment. Thus, the radial movement of the head section 4*a* is restricted by the outer peripheral wall 4*d* of the piston wall section 4*b*, so the same effect as the first embodiment can be exerted.

Figure 4:
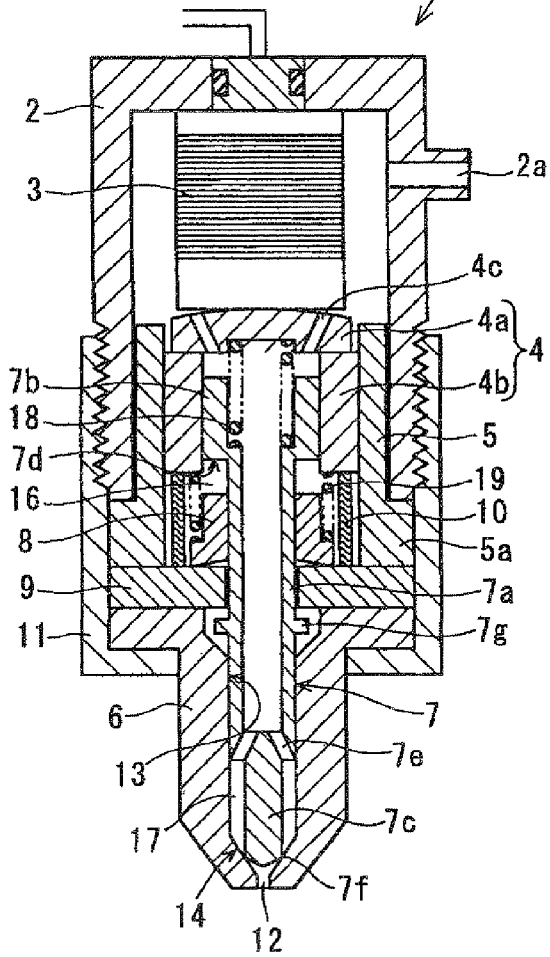
FIG. 4 is a sectional view showing an injector according to a fourth embodiment of the present invention.

Next, an injector 1 according to a fourth embodiment of the present invention will be described with reference to FIG. 4. FIG. 4 is a sectional view showing the injector 1 according to the present embodiment. The injector 1 of the present embodiment is an example formed with a convex contact surface of the head section 4*a* that contacts the axial end face of the piezoelectric actuator 3 as shown in FIG. 4 in addition to the structure described in the first embodiment.

The pressurizing piston 4 is divided into the head section 4*a* and the piston wall section 4*b*, and the two sections 4*a*, 4*b* are put together such that the sections 4*a*, 4*b* can cause relative movement in the radial direction like the first embodiment. The contact surface of the head section 4*a* contacting the axial end face of the piezoelectric actuator 3 is formed in the convex shape (crowning shape). Thus, the head section 4*a* has a peak in the radial center of the contact surface and contacts the axial end face of the piezoelectric actuator 3 at this peak.

With the above-mentioned structure, the peak provided in the contact surface of the head section 4*a* contacts the axial end face of the piezoelectric actuator 3 at one point. Thus, even when the inclination arises in the expansion-contraction direction of the piezoelectric actuator 3, the actuator 3 can drive the head section 4*a* in the axial direction. Accordingly, pinching of the piston wall section 4*b* to the outer sleeve 5 can be inhibited. As a result, the clearance between the sliding sections of the piston wall section 4*b* and the needle 7 can be secured, and the opening/closing action of the needle 7 can be performed certainly.

Figure 5:
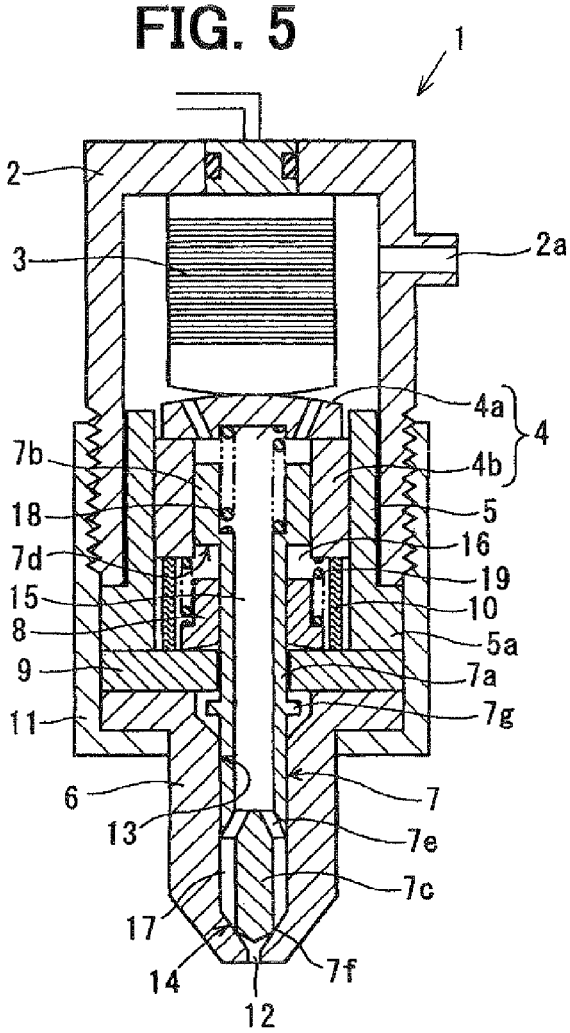
FIG. 5 is a sectional view showing an injector according to a fifth embodiment of the present invention.
Figure 6:
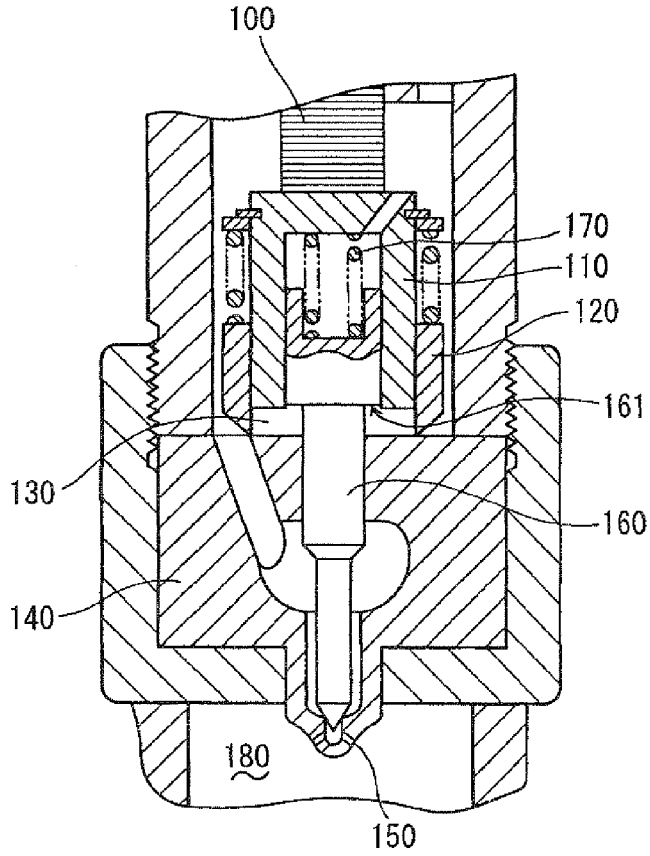
FIG. 6 is a sectional view showing an injector of a related art.

Next, an injector 1 according to a fifth embodiment of the present invention will be described with reference to FIG. 5. FIG. 5 is a sectional view showing the injector 1 according to the present embodiment. The injector 1 of the present, embodiment is an example of forming both the axial end face of the piezoelectric actuator 3 and the contact surface of the head section 4*a* that contacts the axial end face of the actuator 3 in the convex shapes (crowning shapes) as shown in FIG. 5 in addition to the structure described in the first embodiment.

Also in the present embodiment, the axial end face of the piezoelectric actuator 3 contacts the contact surface of the head section 4*a* in one point. Accordingly, like the forth embodiment, even when the inclination arises in the expansion-contraction direction of the piezoelectric actuator 3, the actuator 3 can drive the head section 4*a* in the axial direction. Thus, pinching of the piston wall section 4*b* to the outer sleeve 5 can be inhibited. As a result, the opening-closing action of the needle 7 can be performed certainly.

In the first embodiment, in order to reduce the volume of the pressure control chamber 16, the inner sleeve 8 is arranged on the outer periphery of the middle shaft section 7*a*. Alternatively, the inner sleeve 8 may be eliminated.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An injector comprising:

a piezoelectric actuator that causes displacement in an axial direction thereof when voltage is applied thereto;

a pressurizing piston that is driven by the piezoelectric actuator to move in the axial direction;

a guide wall section that slidably holds an outer periphery of the pressurizing piston;

a valve body that has an injection hole in an axial tip end portion thereof for injecting high pressure fuel;

a needle that is held by the valve body and that operates to open/close the injection hole; and a pressure control chamber for accumulating control pressure concerning the opening/closing operation of the needle, wherein the injector controls the opening/closing operation of the needle by increasing/decreasing the control pressure of the pressure control chamber through the movement of the pressurizing piston, the needle has a middle shaft section held by the valve body, a needle head section that is provided on a side of the middle shaft section opposite from the injection hole and that has an outer diameter larger than that of the middle shaft section, and a pressure receiving surface between the middle shaft section and the needle head section for receiving the control pressure of the pressure control chamber in a valve opening direction, the pressurizing piston has a head section that contacts an axial end face of the piezoelectric actuator to receive the displacement of the piezoelectric actuator and a cylindrical piston wall section that moves in the axial direction in response to the movement of the head section, the piston wall section and the head section are separate bodies and are in contact with each other in a manner such that relative movement therebetween in a radial direction, perpendicular to said axial direction, is possible, an outer periphery of the needle head section is held to an inner periphery of the piston wall section such that the needle head section can move in the axial direction in a sliding manner, and an outer periphery of the piston wall section is held by the guide wall section such that the piston wall section can move in the axial direction in a sliding manner, wherein the piston wall section and the head section are provided such that the piston wall section and the head section can perform the relative displacement in the radial direction in a dimension more than ten times as large as a sliding clearance between the guide wall section and the piston wall section.

2. The injector as in claim 1, wherein the guide wall section restricts radial movement of the head section.

3. The injector as in claim 1, wherein the head section has a convex contact surface, at which the head section contacts an axial end face of the piezoelectric actuator.

4. The injector as in claim 1, wherein the piston wall section has a depressed groove having a depressed inner peripheral face in an axial end face thereof on the head section side and an outer peripheral wall standing on an outer periphery of the depressed groove, and the head section is loosely fitted to the depressed groove such that the outer peripheral wall restricts radial movement of the head section.

* * * * *